US010337184B2

(12) United States Patent
Coupe

(10) Patent No.: US 10,337,184 B2
(45) Date of Patent: Jul. 2, 2019

(54) CONTAINER/BUILDING SYSTEM

(71) Applicant: Paul Michael Coupe, Southport (AU)

(72) Inventor: Paul Michael Coupe, Southport (AU)

( * ) Notice: Subject to any disclaimer, the term of this patent is extended or adjusted under 35 U.S.C. 154(b) by 0 days.

(21) Appl. No.: 14/431,581

(22) PCT Filed: Oct. 2, 2013

(86) PCT No.: PCT/AU2013/001125
§ 371 (c)(1),
(2) Date: Mar. 26, 2015

(87) PCT Pub. No.: WO2014/053011
PCT Pub. Date: Apr. 10, 2014

(65) Prior Publication Data

US 2015/0247316 A1 Sep. 3, 2015

(30) Foreign Application Priority Data

Oct. 2, 2012 (AU) ..... 2012904278

(51) Int. Cl.

| | |
|---|---|
| ***E04B 1/343*** | (2006.01) |
| ***B65D 88/52*** | (2006.01) |
| ***B65D 90/00*** | (2006.01) |
| ***E04B 1/38*** | (2006.01) |
| ***E04H 1/12*** | (2006.01) |
| *E04B 1/24* | (2006.01) |

(52) U.S. Cl.

CPC ..... *E04B 1/34384* (2013.01); *B65D 88/52* (2013.01); *B65D 90/0026* (2013.01); *E04B 1/34315* (2013.01); *E04B 1/34326* (2013.01); *E04B 1/38* (2013.01); *E04H 1/12* (2013.01); *E04B 2001/246* (2013.01); *E04B 2001/2451* (2013.01); *E04B 2001/2472* (2013.01); *E04B 2001/2484* (2013.01); *E04H 2001/1283* (2013.01)

(58) Field of Classification Search

CPC ... E04H 1/12; E04H 2001/1283; B65D 88/52; B65D 90/0026; E04B 1/34384; E04B 1/38; E04B 1/34326; E04B 1/34315; E04B 2001/2451; E04B 2001/246; E04B 2001/2484; E04B 2001/2472

USPC ..... 52/650.1, 66, 68, 69, 79.5, 143, 243.1, 52/65, 71; 220/1.5

See application file for complete search history.

(56) References Cited

U.S. PATENT DOCUMENTS 1,850,513 A * 3/1932 Murphy ..... B66F 3/02 254/101

3,356,395 A 12/1967 C et al.

(Continued)

FOREIGN PATENT DOCUMENTS

GB 1540315 A 2/1979

OTHER PUBLICATIONS

PCT International Search Report dated Jan. 31, 2014 by the ISA/AU; 4 pages.

*Primary Examiner* — Babajide A Demuren

(74) *Attorney, Agent, or Firm* — Landmark Intellectual Property Law PLLC

(57) ABSTRACT

A container/building system comprising; at least one elongate structural member at least one connecting member, the connecting member able to be realisably connected to the structural member and at least one plate that is able to realisably engage with at least one structural member.

33 Claims, 14 Drawing Sheets

(56) References Cited

U.S. PATENT DOCUMENTS 3,459,326 A * 8/1969 Betjemann ..... B65D 88/005 206/512
4,151,925 A * 5/1979 Glassmeyer ..... B65D 88/005 206/386
4,637,763 A 1/1987 Van
4,801,229 A * 1/1989 Hanada ..... B60P 3/08 410/26
4,837,877 A * 6/1989 Hamada ..... A47C 17/84 5/10.2
4,943,204 A * 7/1990 Ehrlich ..... B60P 1/02 187/211
5,020,169 A * 6/1991 Hamada ..... A47C 19/20 5/10.2
5,036,951 A * 8/1991 Frangos ..... E04H 6/06 187/205
5,317,857 A * 6/1994 Allison ..... E04H 1/1205 52/125.6
5,746,343 A * 5/1998 Waltke ..... B65D 19/12 206/600
5,915,913 A * 6/1999 Greenlaw ..... B61D 47/00 187/267
6,027,290 A 2/2000 Andre
6,082,070 A * 7/2000 Jen ..... E04B 1/24 403/170
6,227,397 B1 5/2001 Kim
6,485,237 B1 * 11/2002 Sandwith ..... B60P 3/08 410/24
6,585,126 B1 * 7/2003 Grigsby, Sr. ..... B65D 19/12 206/600
6,615,549 B1 * 9/2003 Hodge ..... B60P 1/00 135/88.01
6,726,041 B2 * 4/2004 Dunn ..... B65D 19/12 206/335
6,983,979 B2 * 1/2006 Rasmussen ..... A47C 17/84 296/156
7,267,229 B2 * 9/2007 Chen ..... B65D 19/06 206/386
7,377,362 B2 * 5/2008 Blodgett, Jr. ..... B60P 3/39 187/222
7,624,887 B2 * 12/2009 Avery ..... B65D 7/24 220/668
7,762,417 B2 * 7/2010 Arnold ..... B65D 19/18 206/335
7,971,713 B2 * 7/2011 Kim ..... B60P 3/08 206/335
8,616,388 B2 * 12/2013 Butler ..... A47B 43/00 108/106
2005/0239586 A1 * 10/2005 Nebel ..... A63H 17/05 474/58
2008/0041745 A1 * 2/2008 Arnold ..... B65D 19/18 206/335
2008/0053003 A1 * 3/2008 Hockemeyer ..... E04B 1/34315 52/22
2010/0176704 A1 7/2010 Kim
2011/0023925 A1 2/2011 Johnson et al.

* cited by examiner

CONTAINER/BUILDING SYSTEM

FIELD OF THE INVENTION

This invention relates to a container/building system. In particular the invention relates to a modular container that can be assembled and disassembled to serve various needs including those of an expedient building system.

BACKGROUND TO THE INVENTION

Containers are used throughout the world to transport cargo. In 2011, approximately 90% of non-bulk cargo worldwide was moved by containers stacked on transport ships. Accordingly, containers form an integral part of the global transportation network for cargo.

Containers are intended to be used constantly. That is once a container is emptied of cargo, the container is reloaded with new cargo destined for a new destination. However, refilling a container once it has reached its destination is not always possible. The cost of transporting an empty container to a place where it is to be used is often considerably higher than the value of the used container. This often leads to unwanted stockpiling of containers at one location with a shortage of containers in another location.

The reference to any prior art in the specification is not, and should not be taken as, an acknowledgment or any form of suggestion that the prior art forms part of the common general knowledge.

OBJECTIVE OF THE INVENTION

It is an objective of the invention to overcome and/or alleviate one or more of the above disadvantages and/or to provide the consumer with a useful and/or commercial choice.

SUMMARY OF THE INVENTION

In one form, although not necessarily the only or broadest form, the invention resides in a container building system comprising;

at least one elongate structural member;

at least one connecting member, the connecting member able to be realisably connected to the structural member; and at least one plate that is able to realisably engage with at least one structural member.

The elongate structural member typically is either a beam or a post. The elongate structural member may be constructed from any suitable material. However, typically the elongate structural member is manufactured from steel, aluminium or composite material.

The elongate structural member may include a series of engagement members. The engagement members may be used to engage with the at least one plate.

The engagement members may form a repetitive pattern along at least part of the length of an elongate structural member. Typically, the engagement members extend along the majority of a length of an elongate structural member. Normally the engagement members are located only on a single side of a structural member. However, the engagement members may be located on more than one side of a structural member if desired.

Preferably the engagement members are in the form of a repeating wave. The wave may be a sine wave, modified square wave, triangular wave or saw tooth wave.

One or more of the engagement members may include an aperture that extends through the engagement member.

One or more joining members may be used to connect one or more elongate structural members to each other using one or more apertures that extend through the engagement members. Each joining member may include two or more engagement pins that may be used to connect two structural members together. Typically two or more joining members are used to join two elongate structural members together.

The elongate structural member may include at least one fastening portion to fasten the elongate structural member to the connecting member. Typically there is a fastening portion located adjacent the end of the elongate structural member. Each fastening portion may include at least one captured nut. Alternatively, the fastening portion may include a threaded hole.

The elongate structural member may also include a locating portion to align the elongate structural member with the connecting member. Typically there is a locating portion located adjacent the end of the elongate structural member. The locating portion may be in the form of one or more locating pins. Alternatively, the locating portion may be in the form of locating holes.

The connecting member may, be made from a rectangular prism shaped, hollow body. The connecting member may be able to be connected to at least two elongate structural members. Preferably, the connecting member may be able to be connected to at least two elongate structural members. More preferably, the connecting member may be able to be connected to at least three elongate structural members.

Preferably, the connecting member may be connected to two elongate structural members to allow the elongate structural members to lie in two different planes. More preferably, the connecting member may be connected to three elongate structural members to allow the elongate structural members to lie in three different planes.

The connecting member may include at least one fastening portion to fasten an elongate structural member to the connecting member. A fastening portion of the connecting member is normally used in conjunction with the fastening portion of the elongate structural member to connect elongate structural member to the connecting member. Normally the connecting member has three fastening portions. A fastening portion of the connecting member may be in the form of a bolt or the like fastener.

The connecting member may include at least one access aperture to access the fastening portion of the connecting member. Preferably there are at least three access apertures. More preferably there are three access apertures.

The connecting member may include at least one locating portion to align an elongate structural member with the connecting member. A locating portion of the connecting member is normally used in conjunction with the locating portion of the elongate structural member to align the elongate structural member with the connecting member. Normally the connecting member has three locating portions. The locating portion may be in the form of locating holes. Alternatively, the locating portion may be in the form of one or more locating pins.

The plate typically is used as a floor plate. However, it is envisaged that the plate may be used as a roof plate. The plate has at least one socket for location of an elongate structural member. Typically the plate has at least four sockets. More preferably, the plate has four sockets. The sockets are normally located at respective ends of the plates. However, it is envisaged that the sockets may be located on respective sides of the plate. The sockets are normally located adjacent the corners of the plate.

A series of tie holes may be spaced around the periphery of the plate. A series of ties may be plated within the holes to tie one plate to an adjacent plate. The tie may be located within a top of a one one plate and within a bottom of a tie hole in the adjacent plate. The ties may be substantially Z-shaped.

Each socket may have a series of engagement members. The engagement members of the socket are typically shaped to engage with the engagement members of an elongate structural member. The engagement members of the socket are shaped in a complimentary fashion to engage with the engagement members of an elongate structural member. Preferably the engagement members of the socket may be in the form of a repeating wave. The wave may be a sine wave, modified square wave, triangular wave or saw tooth wave.

A locking member may be used to hold a connecting member in engagement within a socket of the plate. The locking member may be located on either the connecting member or on the plate or on both. Preferably, the locking member is located in the plate. Typically there are the same number of locking members as there are sockets in the plate.

The plate may have at least one alignment member. Typically the alignment members are used to ensure the sockets are in alignment when plates are stacked on top of each other. Normally, there are at least four alignment members on a top face and bottom face of the plate. The alignment member may be in the form of dimple and/or a projection.

BRIEF DESCRIPTION OF THE DRAWINGS

Embodiment of the invention, by way of example only, will be described with reference to the accompanying drawings in which.

DETAILED DESCRIPTION OF THE PREFERRED EMBODIMENT

Figure 1:
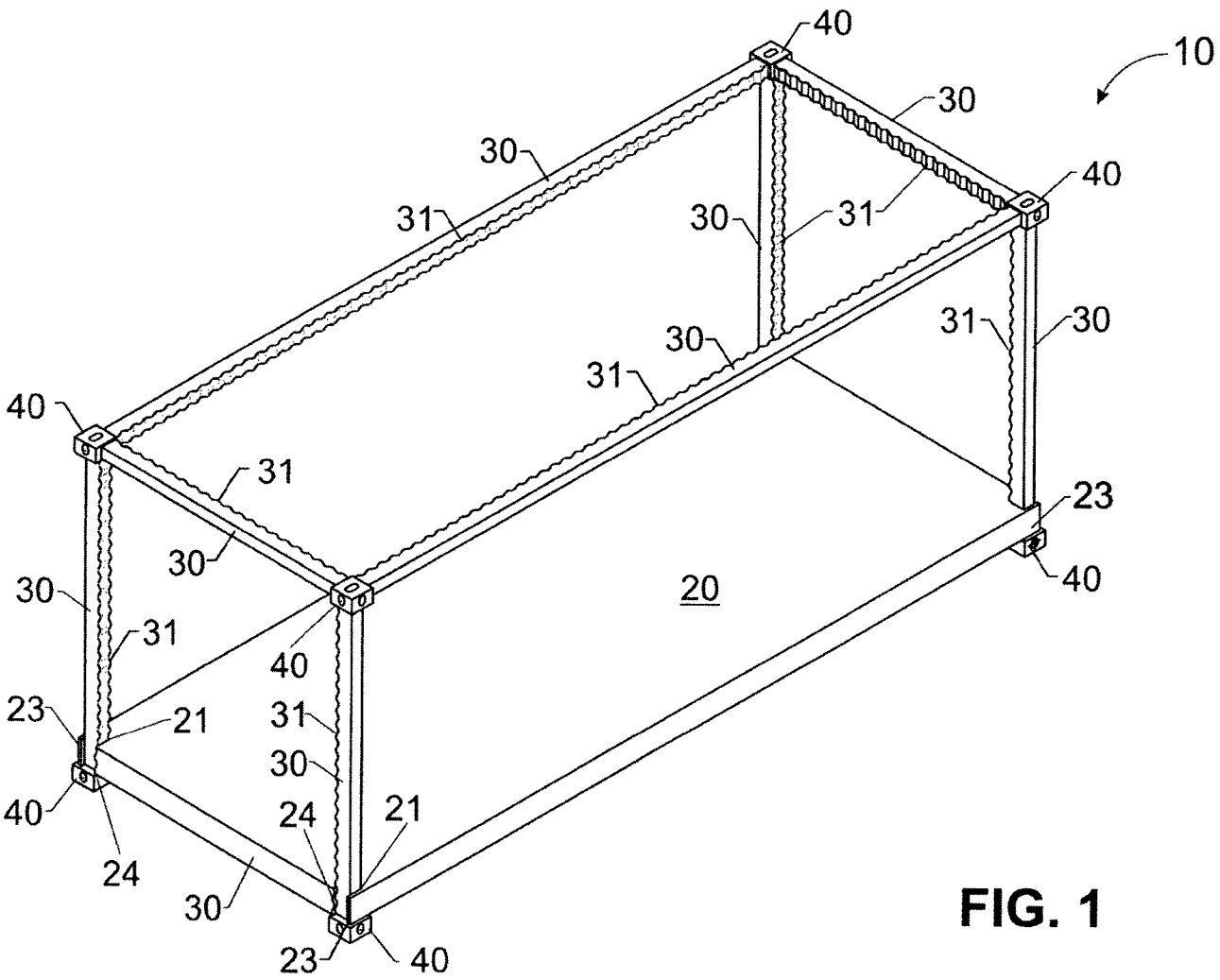
FIG. 1 is an isometric view of a container/building system according to a first embodiment of the invention.

FIG. 1 shows a modular container/building system 10 that is able to be assembled for carrying cargo and disassembled for transportation to other sites with a greatly reduced volume, that can then be assembled and disassembled to serve various needs including those of an expedient building system.

The container/building system 10 includes a floor plate 20, a number of elongate structural members 30 and a number of connecting members 40.

Figure 2:
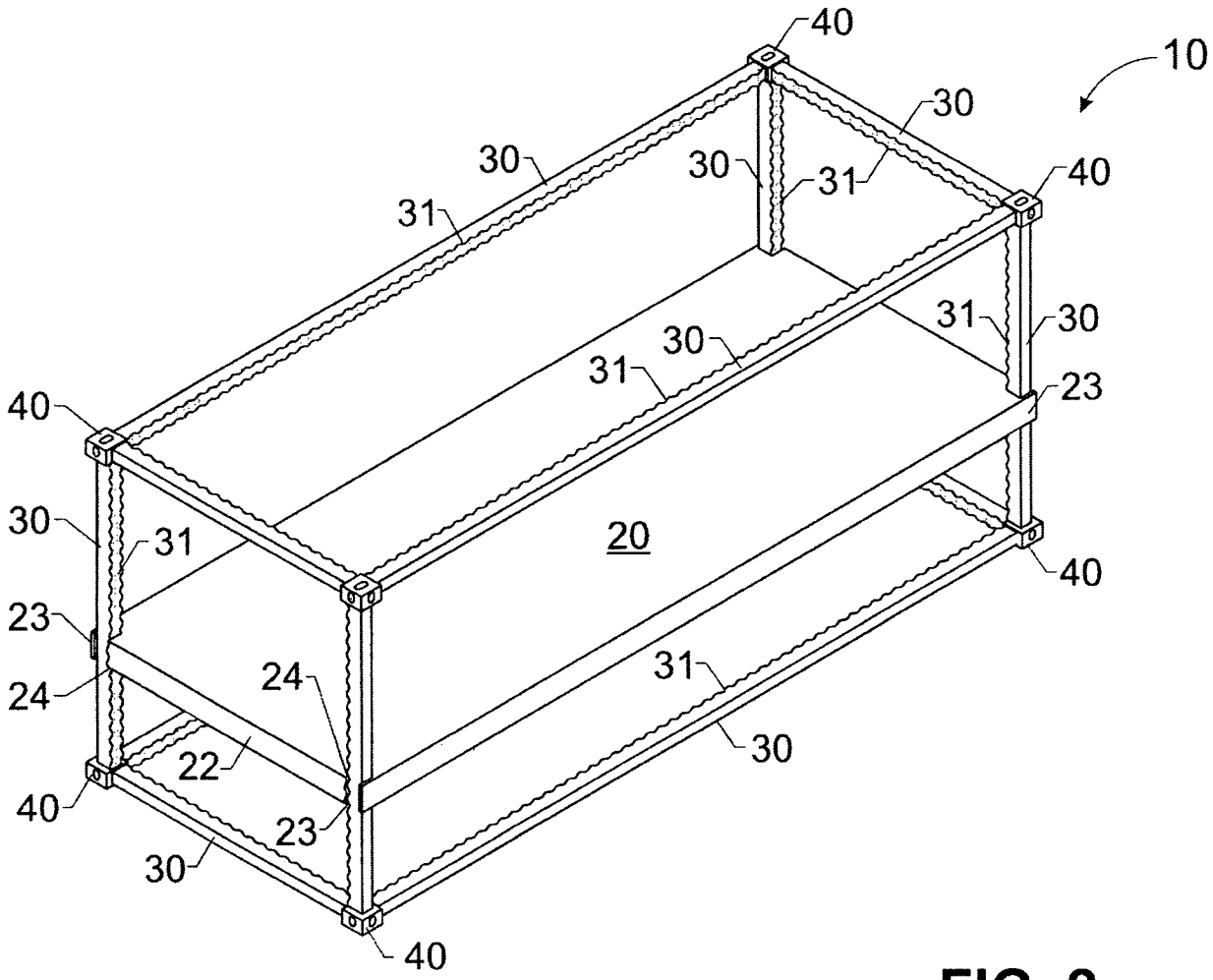
FIG. 2 is a further isometric view of a container/building system according to a first embodiment of the invention.

FIG. 1 shows a modular container/building system with the floor plate at a lower level whist FIG. 2 shows a modular container/building system that has been assembled with the floor plate installed at an intermediate level.

The floor plate 20 is sustainably rectangular in shape and is constructed from steel. However it should be appreciated that other suitable materials may be used. The plate has four sockets 21 which are located within ends 22 of the floor plate. The respective sockets 21 are located adjacent corners 23 of the floor plate. Each of the sockets 21 is profiled to form engagement members 24. The engagement members 24 are formed in one side of the socket 21. However it should be appreciated that the engagement members 24 may be formed on opposite sides of the sockets. The engagement members 24 are in the form of a sine wave.

The floor plate also includes a series spaced apart projections (not shown) located on a top face of the floor plate and a series of dimples (not shown) located in a bottom face of the floor plate. The projections and dimples are relatively sized so that the dimples on one plate will receive the projections of another plate. The projections and dimples are used to align stacked plate.

The elongate structural members 30 are either posts or beams. For example in this embodiment there are four posts and eight beams. The posts and beams can be of variable length. However both the posts and beams are made from the same structural materials and have the same profile. Accordingly posts can be used as beams and vise versa.

Each elongate structural member 30 has a series of engagement members 31. The engagement members 31 run along one single side of the elongate structural member 30. The engagement members 31 are in the form of a sine wave.

Figure 4:
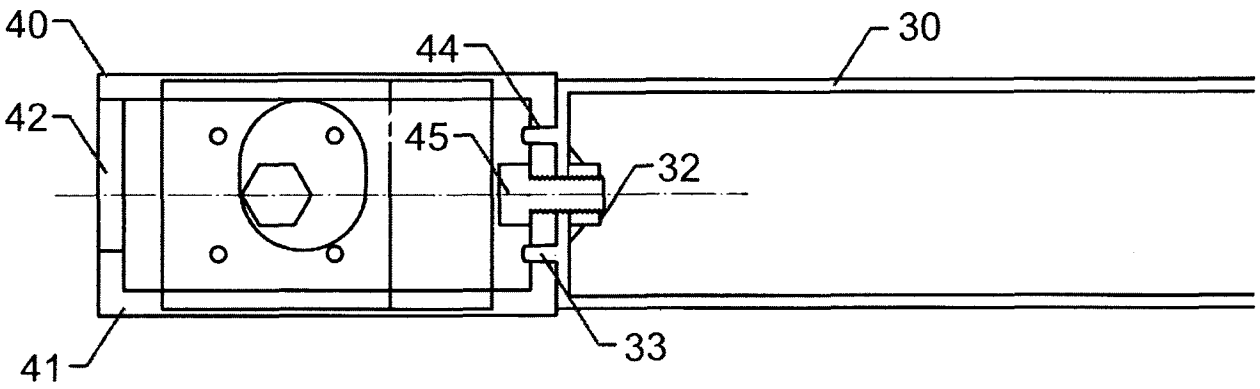
FIG. 4 is a side sectional view of a connecting member attached to an elongate structural member.

Each elongate structural member 30 is hollow. A captured nut 32 is located within each end of the elongate structure member. Two locating pins 33 are formed at end of the elongate structure member. The captured nut 32 and locating pins 33 are shown in FIG. 4.

Figure 3:
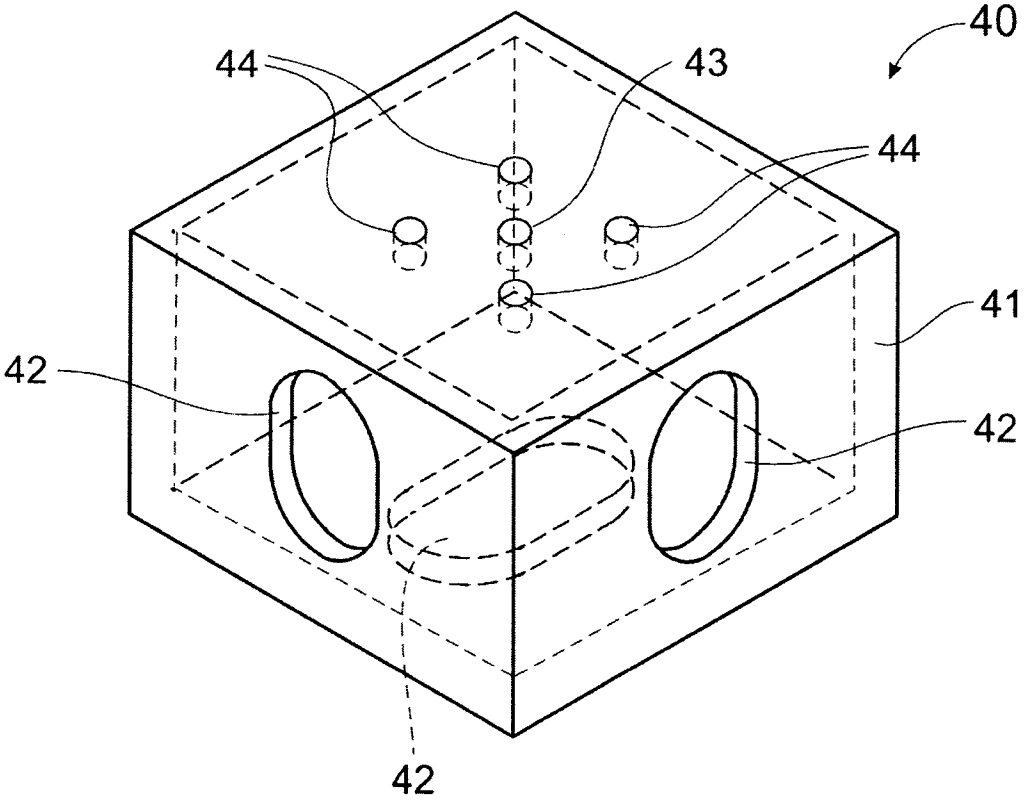
FIG. 3 is an isometric view of a connecting member according to a first embodiment of the invention.

The connecting members 40 are located at the corners of the container/building system 10. A detailed view of the connecting member 40 is shown in FIG. 3. Each connecting member 40 is formed by a hollow steel body 41. Each connecting member 40 is able to be used to connect three elongate structural members 30. Accordingly the body 41 has three associated bolts (not shown) and three associated access apertures 44. Further the body has three bolt holes 43 and three sets of four locating holes 44 (only one shown for the purposes of clarity). The locating holes 44 are located around the bolt holes 43. However it should be appreciated by a person skilled in the art that the number and position of the locating holes 44 may be varied according to the design.

Figure 5:
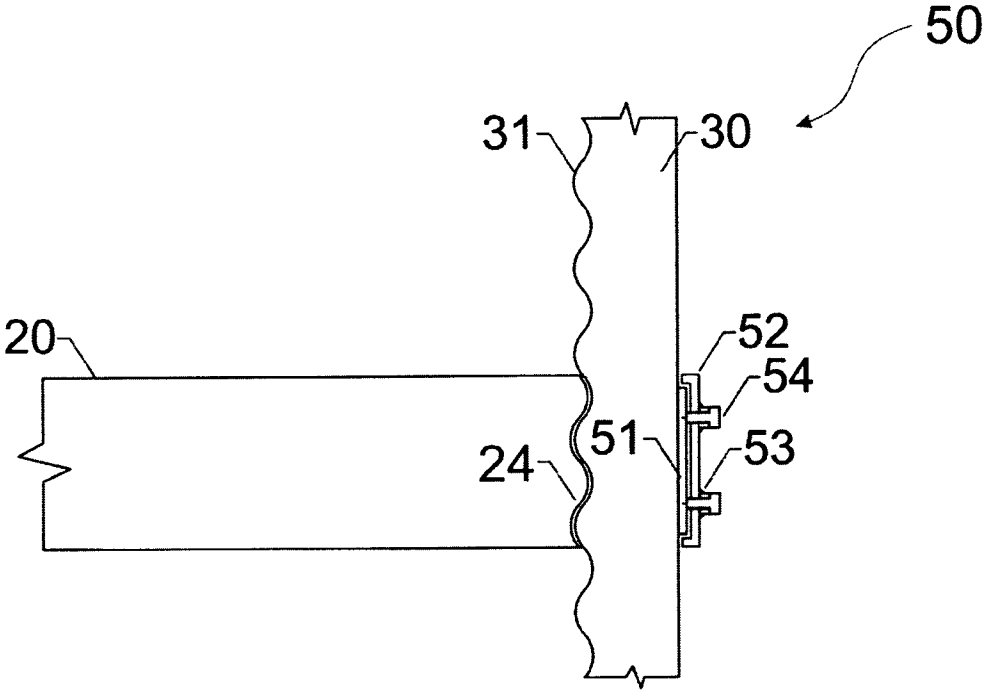
FIG. 5 is a side elevational view of a locking member attaching an elongate structural member to plate.

In order to assemble the container/building system 10, the elongate structural members 30 that form the posts are located within respective sockets 21 of the plate 20. The elongate structural members 30 are orientated so that the engagement members of the elongate structural members 30 mate with the engagement members 24 of their respective sockets 21. A locking member 50 is then activated by tightening bolts 54 forcing a pressure plate 51 against the elongate structural members 30 to prevent removal of the elongate structural members from their respective sockets 21 as shown in FIG. 5.

The connecting members 40 are then attached to each of the ends of the elongate structural members 30 that are engaged with the sockets 21. The connecting members 40 are attached to the ends of the elongate structural members 40 by placing the connecting members 40 adjacent the end of their respective elongate structural members 30 so that the locating pins 33 of respective elongate structural member 30 are located within the locating holes 44 of the connecting member 40. This is shown is FIG. 3. A bolt 45 is then placed through the appropriate access aperture 42 and the bolt hole 43 until it engages the captive nut 32 locating within the elongate structural element 30. The bolt 45 is rotated until the bolt head engages the body 41 of the connecting member 40. A tool, such as a wheel brace, is then used to tighten the bolt 45 sufficiently so that the elongate structural member 30 is held tightly to the connecting member 40. This process is repeated for all of the elongate structural members 30 that form beams.

In order to disassemble the container/building system the bolts 45 are simply removed from the elongate structural members 30 to enable the connecting members 40 to be removed from the elongate structural members 30. The locking members 50 are then released, opening the respective sockets 21 to enable the elongate structural members 30 to be removed from the plate 20. In the disassembled state, the container/building systems are able to be transported in bulk.

Figure 6C:
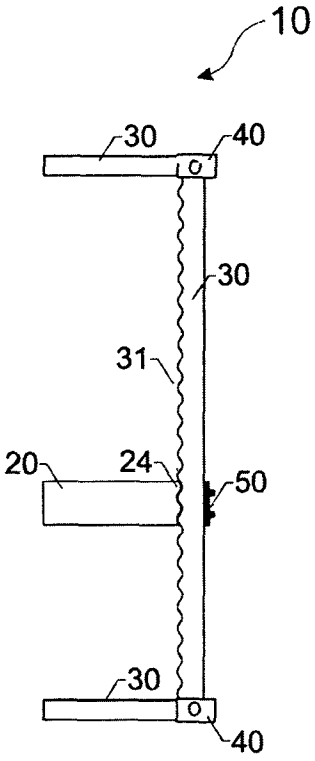
FIG. 6C is, a side elevational view of a container/building system having a single floor plate located in a different position to that shown in FIG. 4A.
Figure 6B:
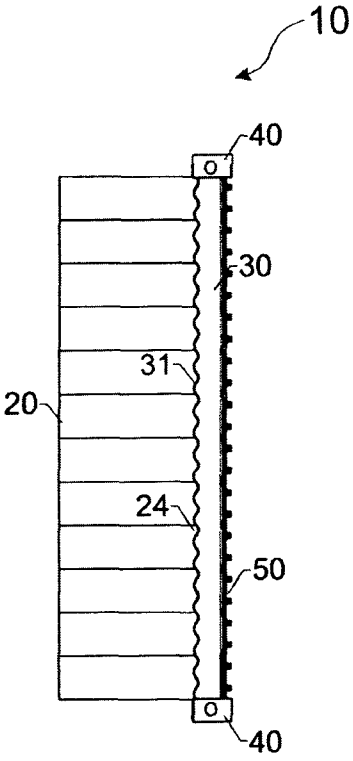
FIG. 6B is a side elevational view of a container/building system that has numerous floor plates stacked together.
Figure 6A:
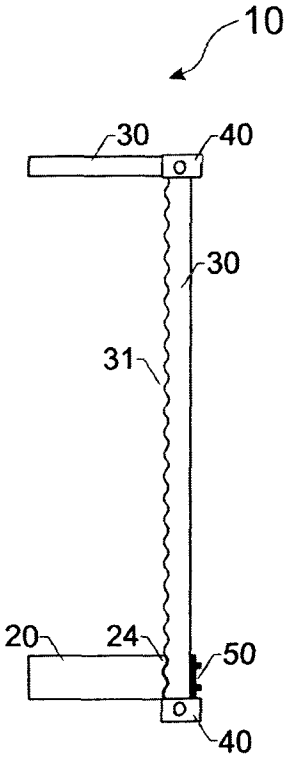
FIG. 6A is a side elevational view of a container/building system having a single floor plate.

FIG. 6B show a number of floor plates 20 that have been stacked together. The floor plates 20 are aligned using projections which are located in a top face that mate with dimples located in a bottom face. This ensures that all of the sockets 21 are in alignment. When the sockets 21 are in alignment an elongate structural member 30 can be located through each of the sockets 21. The locking members 50 can then be simply be engaged to ensure that the elongate member do not become displaced from the sockets 21.

FIG. 6C shows that the position of a floor plate 20 can be varied with respect to the elongate structural member 30.

Figure 7:
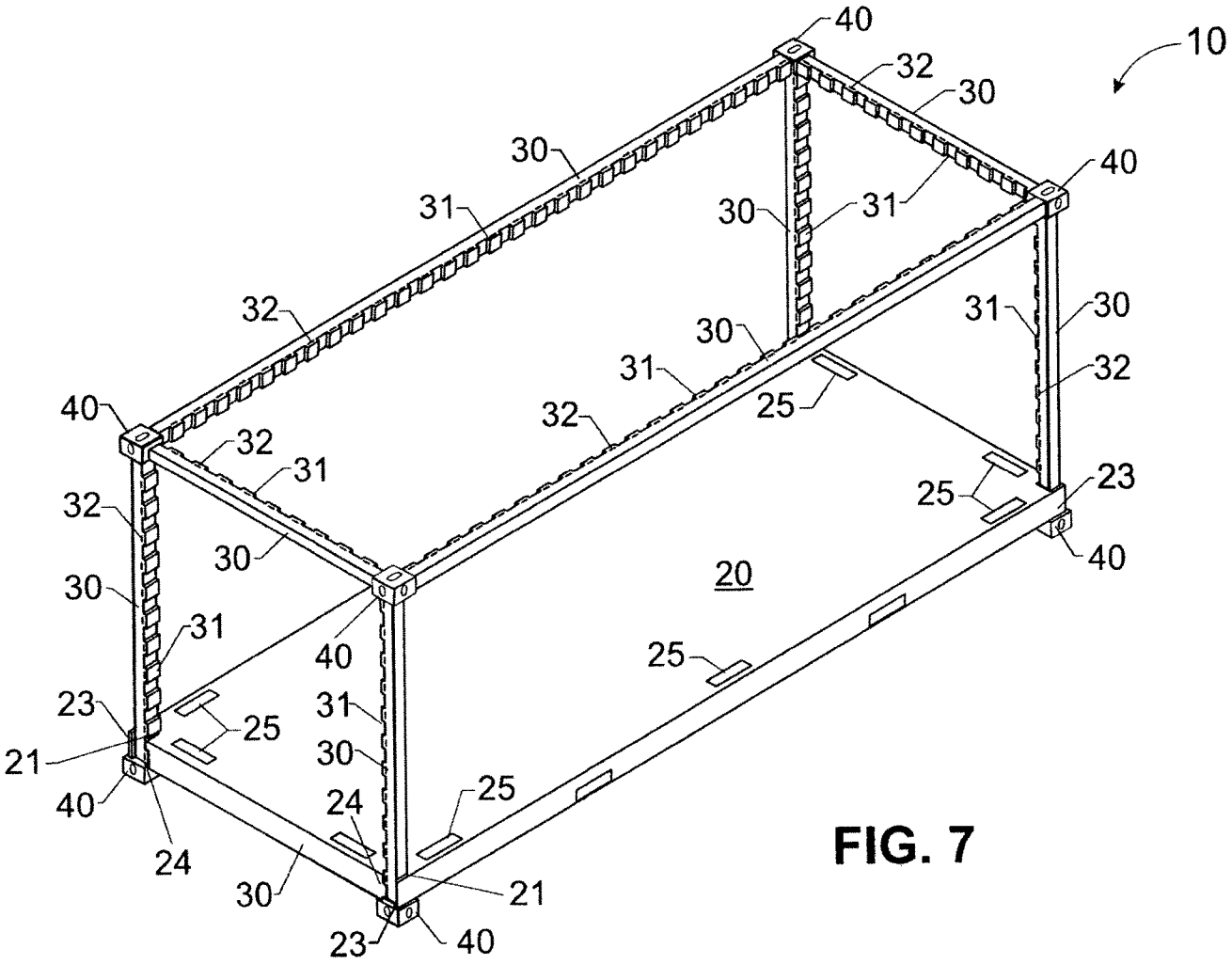
FIG. 7 is an isometric view of a container/building system according to a second embodiment of the invention.
Figure 8:
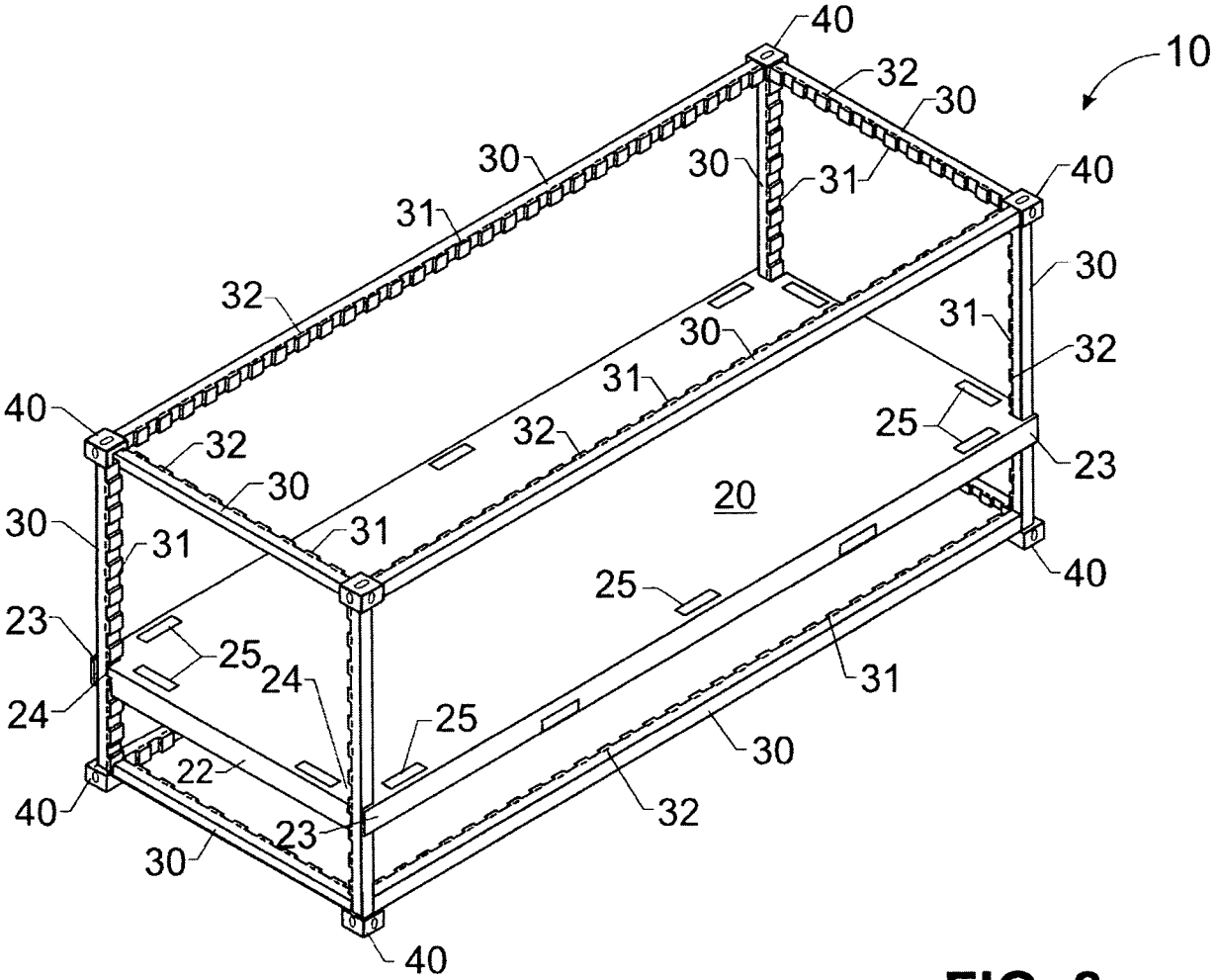
FIG. 8 is a further isometric view of a container/building system according to a second embodiment of the invention.

FIG. 7 and FIG. 8 show a second embodiment of the invention. Like numerals have been used to describe like components. In this embodiment the engagement members 31 located on each of the elongate structural members 30 are in the form of a modified square wave as opposed to a sine wave. Similarly, engagement members 24 of located within sockets 21 of the plate 20 are also in the form of a modified square wave as opposed to a sine wave. The connection and disconnection of the elongate structural members 30 and the plate 20 are the same as described in the first embodiment.

Figure 9C:
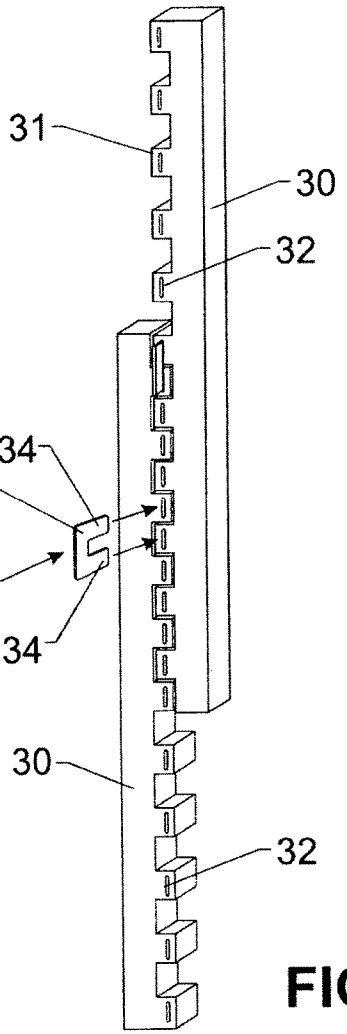
FIG. 9A to 9C show a detailed view of two elongate support members being joined together according to a second embodiment of the invention.
Figure 9B:
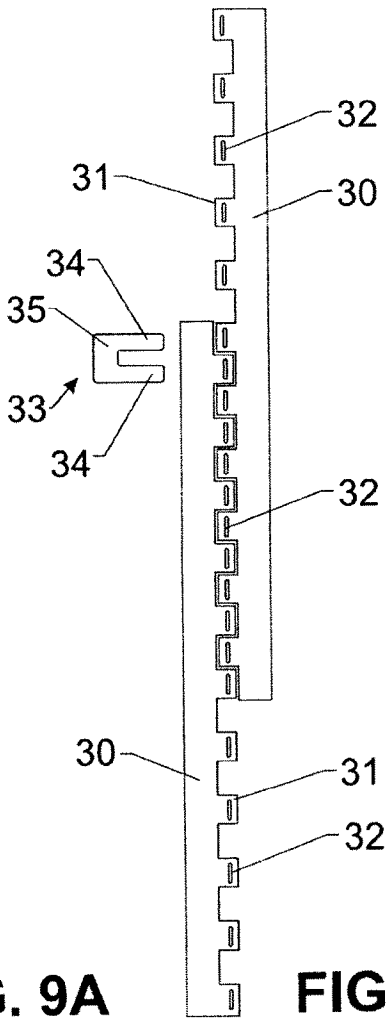
Figure 9A:
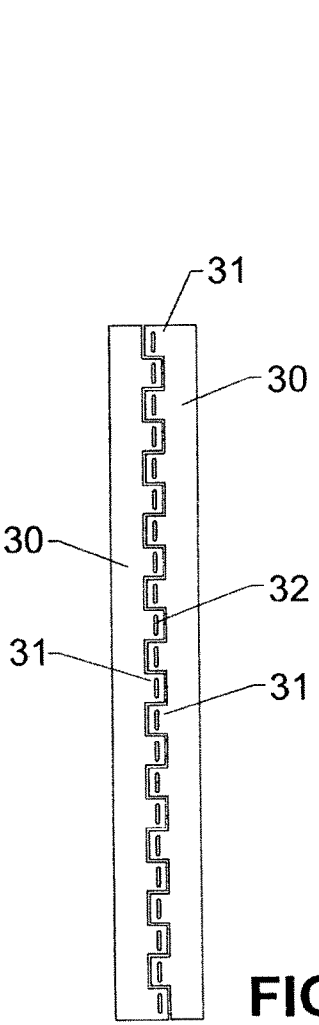

Apertures 32 are located within each of the engagement members 31 located on each of the elongate structural members 30 as shown more clearly in FIGS. 9A to 9C. These apertures 32 are used in conjunction with a joining member 33. The joining member 33 is formed from two pins 34 and a body 35 which are spaced and sized to be located within two apertures 32 of different elongate structural members 30. The two joining pins 34 are spaced apart and extend outwardly from the body 35.

In use, two elongate structural members 30 that are to be joined together are located adjacent each other so that their respective engagement members 31 are engaged. The joining pins 34 of the joining member 33 are then inserted into apertures 32 of different elongate structural members 30. This prevents separation of the two elongate structural members 30 with any down force being applied through the engagement members 31.

Figure 10:
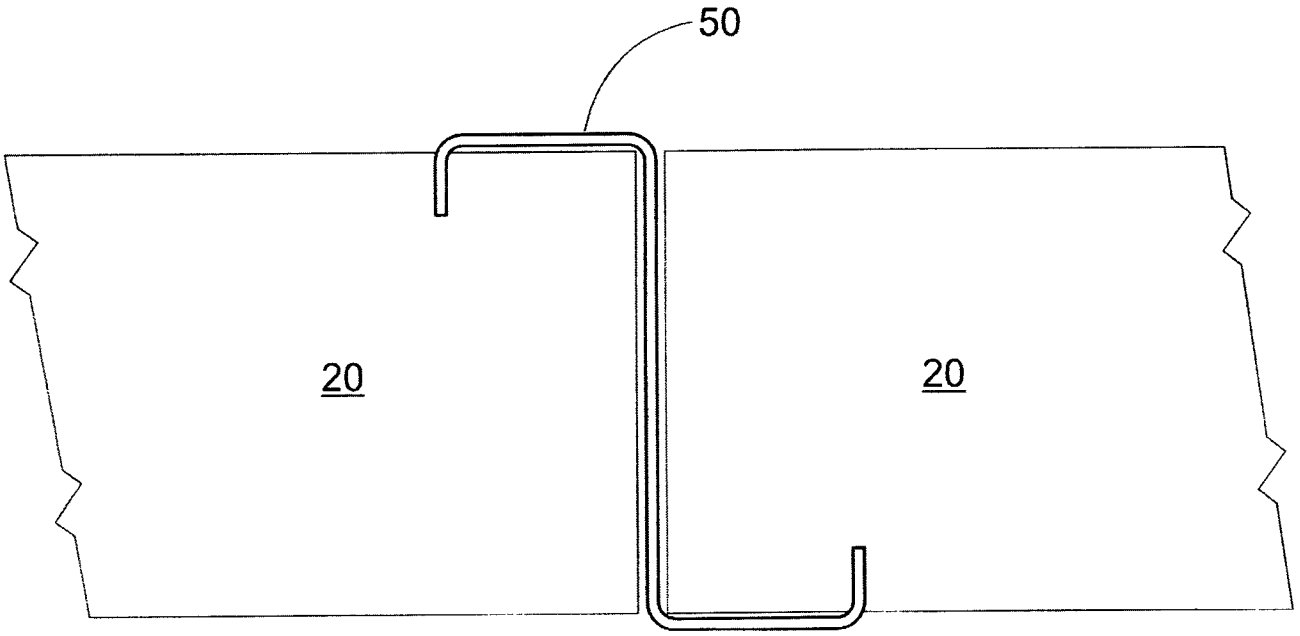
FIG. 10 shows a detailed view of two plates being joined together according to a second embodiment of the invention.

The plate 20 in this embodiment also has a series of tie holes 25 that are used to connect and support an adjacent plate 20A as shown in FIG. 10. The tie holes 25 are within the plate 20 and are spaced around the plate 20. Two tie holes 25 are located adjacent each end of the plate 20 and three tie hole 25 are located adjacent each side of the plate 20. Ties 50 are used in conjunction with the tie hoes to attach one plate 20 to an adjacent plate. Each tie 50 is in the form of a Z-shaped clip. The ties 50 are located within the top of the holes 50 on the plate 20 which is used to support the adjacent plate 20A. The ties 50 are located within the bottom of the slots in supported plate 20.

Figure 11A:
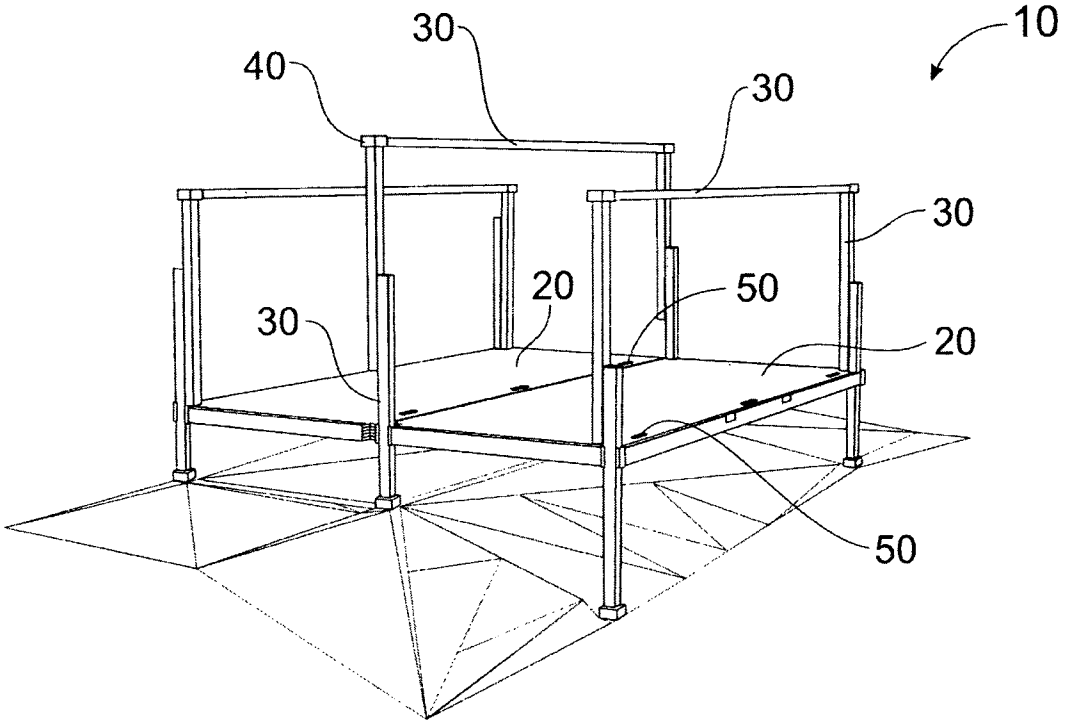
FIG. 11A to 11D show perspectives views of how the container/building system can be used.
Figure 11B:
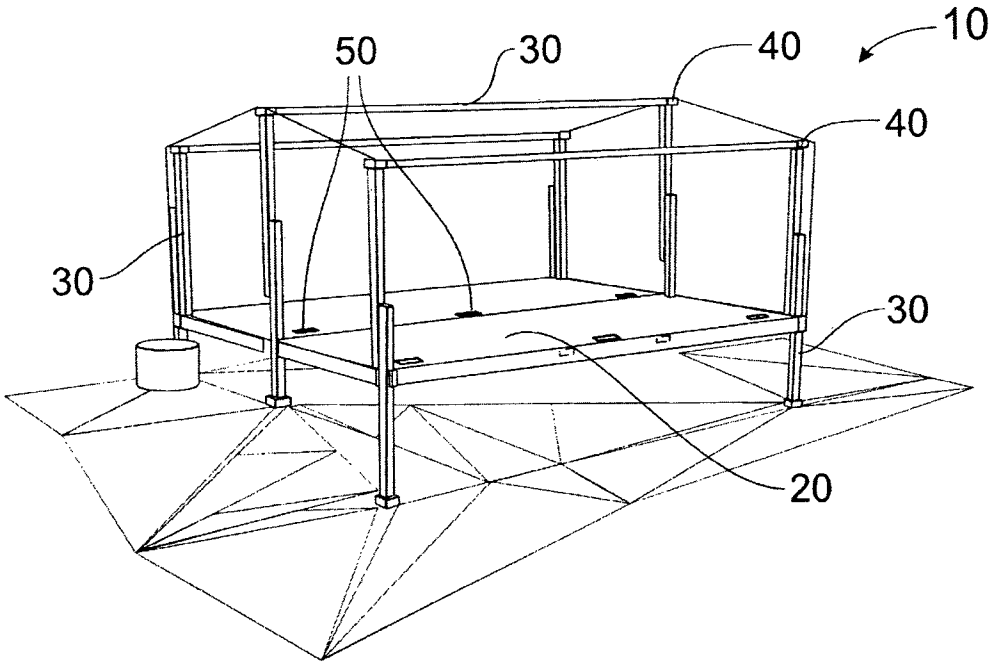
Figure 11C:
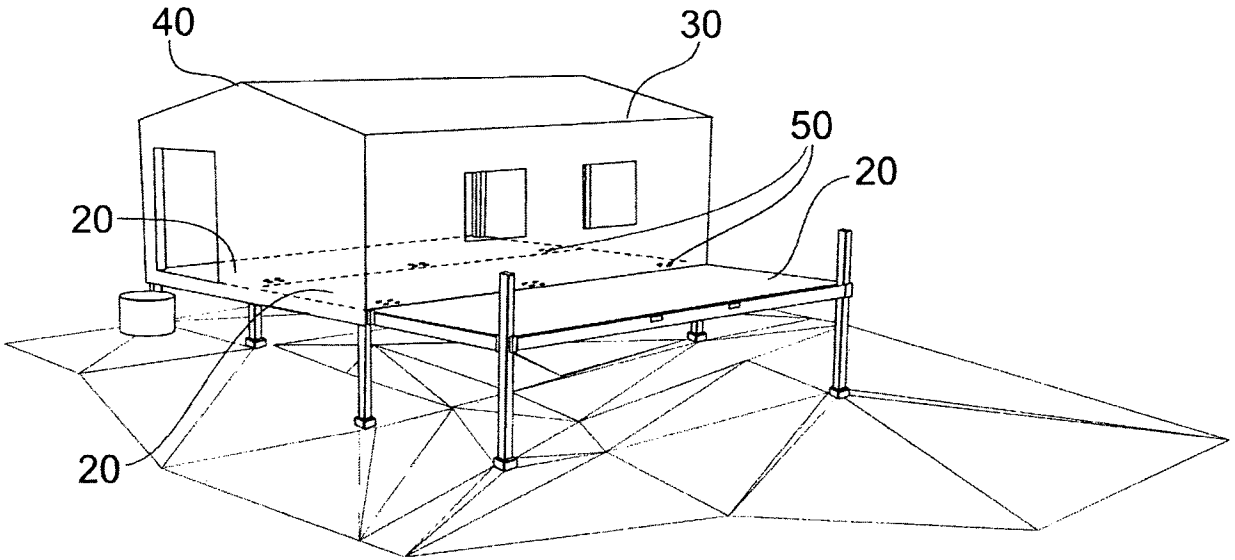
Figure 11D:
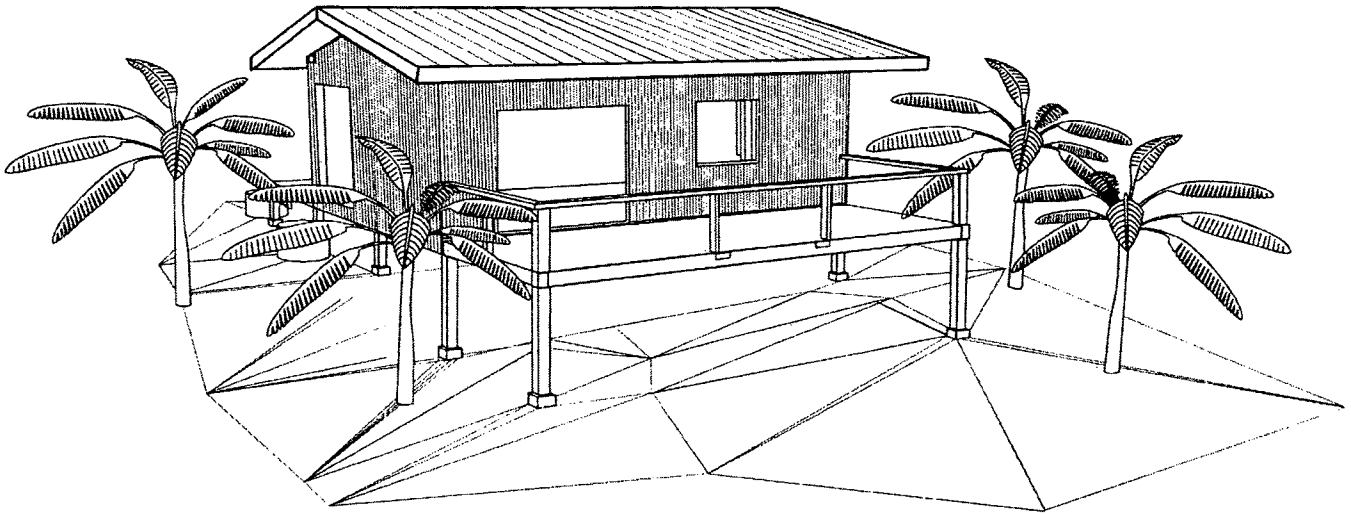

FIG. 11A to 11D show the container/building system shown in FIGS. 7 to 10 in practical use. FIG. 11A shows how a basic frame structure can be created using plates 20, elongate structural members 30, connecting members 40, and ties 50. A cover can then be used to cover the frame as shown in FIG. 11B. Extensions can be made as shown in FIG. 11C. Hard cladding can also be added as shown in FIG. 11D.

In this specification, the terms "comprise", "comprises", "comprising" or similar terms are intended to mean a non-exclusive inclusion, such that a system, method or apparatus that comprises a list of elements does not include those elements solely, but may well include other elements not listed.

It should be appreciated that various other changes and modifications may be made to the embodiment described without departing from the spirit or scope of the invention.

What is claimed is:

1. A shipping container/building system comprising;

at least one elongate structural member, the at least one elongate structural member including a series of engagement members that form a repetitive pattern along at least part of a length of the at least one elongate structural member;

at least one connecting member, the connecting member able to be releasably connected to the at least one elongate structural member; and at least one plate that is able to releasably engage with at least one of the at least one elongate structural member;

wherein the plate has at least one socket for location of at least one of the at least one elongate structural member, wherein each socket has a series of non-rotatable engagement members shaped to engage with the engagement members of at least one of the elongate structural member located therein, and wherein the series of engagement members of the socket are formed on a linear surface of the socket, wherein the series of engagement members of the socket are fixedly attached to the socket, wherein the series of engagement members of the at least one elongate structural member are formed on a linear surface of the at least one elongate structural member; and wherein two elongate structural members are configured to be joined together by a joining member to increase a vertical height of the shipping container/building system.

2. The shipping container/building system of claim 1 wherein the at least one elongate structural member is a beam or a post.

3. The shipping container/building system of claim 1, wherein the engagement members extend along the majority of a length of the at least one elongate structural member.

4. The shipping container/building system of claim 1 wherein the engagement members are located only on a single side of the at least one elongate structural member.

5. The shipping container/building system of claim 1, wherein the engagement members are in the form of a repeating wave, selected from the group comprising a sine wave, a modified square wave, a triangular wave, and a saw tooth wave.

6. The shipping container/building system of claim 1, wherein one or more of the engagement members include an aperture that extends through the engagement member.

7. The shipping container/building system of claim 6 including at least one joining member located within at least one aperture of an engagement member of two elongate structural members.

8. The shipping container/building system of claim 7 wherein each joining member includes two or more engagement pins.

9. The shipping container/building system of claim 1, wherein the elongate structural member includes at least one fastening portion to fasten the elongate structural member to the connecting member.

10. The shipping container/building system of claim 9 wherein the fastening portion of the elongate structural member is located adjacent to the end of the elongate structural member and includes at least one captured nut or a threaded hole.

11. The shipping container/building system of claim 1 wherein the elongate structural member also includes a locating portion to align the elongate structural member with the connecting member.

12. The shipping container/building system of claim 11 wherein the locating portion is located adjacent the end of the elongate structural member.

13. The shipping container/building system of claim 11 wherein the locating portion is in the form of one or more locating pins or one or more locating holes.

14. The container/building system of claim 1, wherein the connecting member is connected to at least two elongate structural members, the connecting member allowing the elongate structural members to lie in two different planes.

15. The shipping container/building system of claim 9, wherein the connecting member includes at least one fastening portion to fasten an elongate structural member to the connecting member and wherein the fastening portion of the connecting member is used in conjunction with the fastening portion of the elongate structural member to connect elongate structural member to the connecting member.

16. The shipping container/building system of claim 15 wherein the connecting member has three fastening portions.

17. The shipping container/building system of claim 15, wherein the fastening portion of the connecting member is in the form of a bolt.

18. The shipping container/building system of claim 15, wherein the connecting member includes at least one access aperture to access the fastening portion of the connecting member.

19. The shipping container/building system of claim 18 wherein there are at least three access apertures.

20. The shipping container/building system of claim 1, wherein the connecting member includes at least one locating portion to align an elongate structural member with the connecting member.

21. The shipping container/building system of claim 20 wherein the locating portion of the connecting member is used in conjunction with the locating portion of the elongate structural member to align the elongate structural member with the connecting member.

22. The shipping container/building system of claim 20 wherein the connecting member has three locating portions.

23. The shipping container/building system of claim 20 wherein the locating portion is in the form of locating holes.

24. The shipping container/building system of claim 20 wherein the locating portion is in the form of one or more locating pins.

25. The shipping container/building system of claim 1 wherein the connecting member is a rectangular prism shaped, hollow body.

26. The shipping container/building system of claim 1, wherein the plate has at least four sockets.

27. The shipping container/building system of claim 26 wherein the sockets are located at respective ends of the plates.

28. The shipping container/building system of claim 26 wherein the sockets are located adjacent the corners of the plate.

29. The shipping container/building system of claim 1, wherein the engagement members are in the form of a repeating wave selected from the group comprising: a sine wave, a modified sine wave, triangular wave, and saw tooth wave.

30. The shipping container/building system of claim 1, wherein a locking member is used to hold a connecting member in engagement within the at least one socket of the plate.

31. The shipping container/building system of claim 30 wherein the locking member is located on either the connecting member or on the plate or on both.

32. The shipping container/building system of claim 1, wherein the plate has at least one alignment member in the form of a dimple and/or a projection.

33. The shipping container/building system of claim 32 wherein there are at least four alignment members on a top face and bottom face of the plate.

* * * * *